US009610607B2

(12) United States Patent
Wohlhauser et al.

(10) Patent No.: US 9,610,607 B2
(45) Date of Patent: Apr. 4, 2017

(54) METHOD AND DEVICE FOR PRINTING FILMS

(71) Applicant: WIPF AG, Volketswil (CH)

(72) Inventors: Othmar Wohlhauser, Volketswil (CH); Oliver Fankhauser, Volketswil (CH)

(73) Assignee: Wipf AG, Volketswil (CH)

( * ) Notice: Subject to any disclaimer, the term of this patent is extended or adjusted under 35 U.S.C. 154(b) by 0 days.

(21) Appl. No.: 14/664,406

(22) Filed: Mar. 20, 2015

(65) Prior Publication Data

US 2015/0190842 A1 Jul. 9, 2015

Related U.S. Application Data

(63) Continuation of application No. PCT/EP2013/069617, filed on Sep. 20, 2013.

(30) Foreign Application Priority Data

Sep. 21, 2012 (EP) ..... 12185442

(51) Int. Cl.
*B05D 3/02* (2006.01)
*B05D 3/00* (2006.01)
(Continued)

(52) U.S. Cl.
CPC ..... *B05D 3/002* (2013.01); *B05D 3/067* (2013.01); *B41M 5/0011* (2013.01);
(Continued)

(58) Field of Classification Search
CPC .... B41M 7/0045; B41M 7/0081; B41M 5/50; B05D 3/002; B05D 3/005; B05D 3/14
See application file for complete search history.

(56) References Cited

U.S. PATENT DOCUMENTS

2003/0157354 A1* 8/2003 Van Veghel et al. ..... 428/515
2004/0033367 A1* 2/2004 Shimada ..... B32B 25/08 428/422.8

(Continued)

FOREIGN PATENT DOCUMENTS

DE 2460881 A1 6/1976
DE 10041934 A1 3/2002

(Continued)

OTHER PUBLICATIONS

International Search Report and Written Opinion, PCT/EP2013/069617, completed on Nov. 8, 2013, 15 pages, with Machine English Translation.

(Continued)

*Primary Examiner* — Betelhem Shewareged
(74) *Attorney, Agent, or Firm* — Ewers & Hasselmann PLLC

(57) ABSTRACT

A method for digital printing of a composite film or a film is provided in which a corona pretreatment of the composite film or the film is performed, the film is primed with a primer, a corona pretreatment of the primed composite film or the film is performed, the corona-pretreated, primed composite film or the film is printed using a digital printing method, and a protective paint is applied on the printed, corona-pretreated, primed composite film or the film.

13 Claims, 1 Drawing Sheet

(51) Int. Cl.

| | |
|---|---|
| ***B41M 5/00*** | (2006.01) |
| ***B41M 5/52*** | (2006.01) |
| ***B41M 7/00*** | (2006.01) |
| ***B05D 3/06*** | (2006.01) |

(52) U.S. Cl.
CPC ..... *B41M 5/0064* (2013.01); *B41M 5/52* (2013.01); *B41M 7/0045* (2013.01); *B41M 5/5281* (2013.01); *B41M 2205/38* (2013.01); *Y10T 428/24851* (2015.01)

(56) References Cited

U.S. PATENT DOCUMENTS

| | | | | |
|---|---|---|---|---|
| 2004/0040460 | A1 | 3/2004 | Frei et al. | |
| 2004/0055698 | A1 | 3/2004 | Tran | |
| 2005/0019533 | A1* | 1/2005 | Mossbrook et al. | 428/204 |
| 2009/0120782 | A1 | 5/2009 | Hammen et al. | |
| 2009/0184168 | A1* | 7/2009 | Ricketts | B32B 27/08 235/492 |
| 2012/0211553 | A1 | 8/2012 | Neary | |
| 2014/0161986 | A1 | 6/2014 | De Rossi et al. | |
| 2015/0122139 | A1* | 5/2015 | Oz | B41M 5/025 101/217 |
| 2015/0158241 | A1* | 6/2015 | Dohring | B44C 5/04 428/195.1 |

FOREIGN PATENT DOCUMENTS

| | | | |
|---|---|---|---|
| DE | 102008063837 | A1 | 6/2010 |
| DE | 102009043042 | A1 | 3/2011 |
| EP | 1104694 | A2 | 6/2001 |
| JP | 2003-535721 | A | 12/2003 |
| JP | 2004-114038 | A | 4/2004 |
| JP | 2012-509980 | A | 4/2012 |
| WO | 01-94451 | A2 | 12/2001 |
| WO | 0194451 | A2 | 12/2001 |
| WO | 0220276 | A1 | 3/2002 |
| WO | 09-053311 | A2 | 4/2009 |
| WO | 12-001109 | A1 | 1/2012 |

OTHER PUBLICATIONS

EP Search Report and Written Opinion, EP 12185442, completed on Mar. 14, 2013, 12 pages, with Machine English Translation.

Office Action in corresponding Japanese Application No. 2015-532431, mailed on Oct. 27, 2015, with English translation.

Opposition filed in corresponding European Application No. 2711191, mailed on Aug. 11, 2015, with English language machine translation.

* cited by examiner

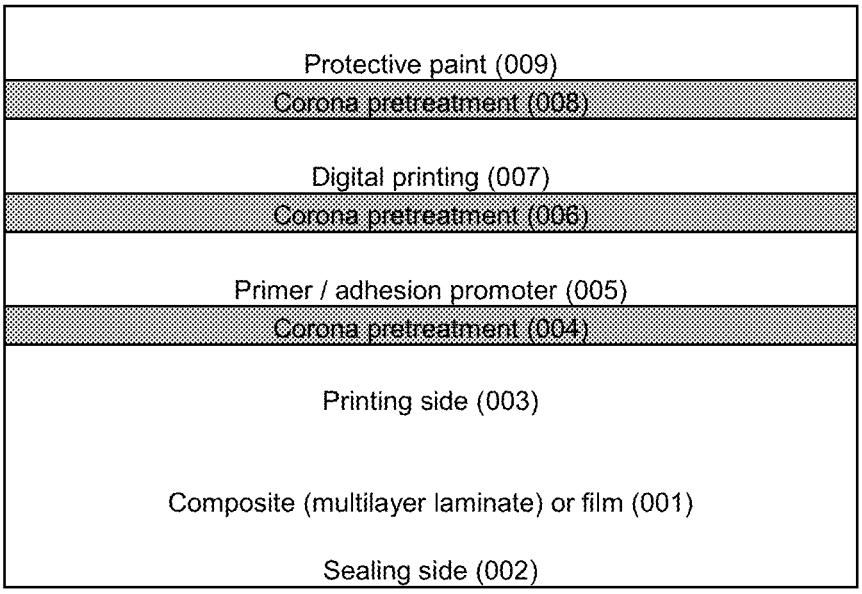
Protective paint (009)
Corona pretreatment (008)
Digital printing (007)
Corona pretreatment (006)
Primer / adhesion promoter (005)
Corona pretreatment (004)
Printing side (003)
Composite (multilayer laminate) or film (001)
Sealing side (002)

METHOD AND DEVICE FOR PRINTING FILMS

CROSS REFERENCE TO RELATED APPLICATIONS

This application is a continuation application of International Application No. PCT/EP2013/069617, filed on Sep. 20, 2013, which claims priority under 35 U.S.C. §119 to Application No. EP 12185442.6 filed on Sep. 21, 2012, the entire contents of which are hereby incorporated by reference.

FIELD OF THE INVENTION

The present invention relates to a method and a device for printing of films as well as a thereby produced composite film.

BACKGROUND

Films are used in the packaging industry, whereby both mono films and composite films are used.

The used films are thereby printed in order to provide information on the product, the producer or the trademark to the consumer and in order to create an aesthetic effect. Besides conventional printing methods, for example gravure printing, digital printing becomes more important and is used on labels, paper applications or so called shrink-sleeves.

However, films, in particular composite films, which are sealable and are sealed during the packaging process, have special requirements concerning the mechanical and thermal stability of the print image, which cannot be fulfilled with conventional digital printing methods and devices.

Normally, these films have typically been printed so far with gravure printing or flexography methods, which is however elaborate.

Using digital printing methods has only been possible so far, if the printing takes place on the inner side of the print substrate of composite films. However, further production processes, for example laminating, curing etc., are then required.

Thus, it would be desirable to provide a method, which enables printing on the outside of films, in particular composite films, and thereby using digital printing methods.

Digital printing of films is generally known. For example, Hewlett Packard offers a digital printing device called Indigo, which is in general suitable for printing of films, too. This device performs a corona pretreatment of the printing side, applies then a primer based on an aqueous solvent and finally digitally prints on the film.

However, films printed in this manner do not provide the required thermal and mechanical stability, which is expected for sealable films.

The problem to be solved by the present invention is providing a method for digital printing with improved thermal and mechanical stability, which can be used for sealable films as well.

SUMMARY

According to one embodiment of the present invention a method for digital printing of a composite film or a film is provided in which a corona pretreatment of the composite film or the film is performed, the film is primed with a primer, a corona pretreatment of the primed composite film or the film is performed. The corona-pretreated, primed composite film or the film is printed in a digital printing method, and a protective paint is applied on the printed, corona-pretreated, primed composite film or the film.

The corona treatment before the priming and before the printing provides a particular high mechanical and thermal stability of the printed film.

According to one embodiment of the present invention, a corona pretreatment of the printed, corona-pretreated, primed composite film or the film is performed before the protective paint is applied. The repeated corona pretreatment additionally increases the stability.

According to one embodiment the primer is a primer based on an organic solvent. Thereby, the stability of the printed film is further increased.

According to one embodiment the primer is a two-component primer. This provides a particularly advantageous embodiment of the primer.

According to one further embodiment, the primer can also be a 1 component primer based on polyurethane or polyvinyl butyral (PVB).

According to one embodiment the protective paint is a protective paint based on an organic solvent. This provides a particularly advantageous embodiment the protective paint.

According to one embodiment the protective paint is a two-component protective paint.

According to one embodiment the primer is applied with a thickness of 0.1 to 1 g/m2. This is a comparatively thin primer layer, which is however sufficient for providing an adequate stability of the print image due to the corona pretreatment.

According to one embodiment the protective paint is applied with a thickness of 0.3 to 2 g/m2.

According to one embodiment a radiation curing paint is used as protective paint, whereby the protective paint is cured by electron beam curing, or the protective paint is cured by UV curing.

According to one embodiment of the present invention a device for digital printing of a composite film or a film is provided which includes one or several modules for carrying out the steps of the method according to one embodiment of the present invention.

According to a further embodiment of the present invention a composite film or a film is provided which is produced by a method according to one of the embodiments of the present invention.

BRIEF DESCRIPTION OF THE DRAWINGS

Example embodiments will now be described with reference to the drawing.

FIG. 1 illustrates a method according to one embodiment of the present invention.

DETAILED DESCRIPTION

Present example embodiments enable printing of sheet composites (multilayer laminates) or films for flexible packagings of food-, non-food-, pet food-, pharma- or medical-applications.

These composites generally include at least two different films, which contain plastic films, and/or metal films, and/or paper films. According to one example embodiment mono films may be used as well.

The printing side of these composites (multilayer laminate) or of the film is first processed with a corona pretreatment on the printing side in order to provide a better primer adhesion, which occurs according to one embodiment inline. The surface to be treated is exposed for a short time to an electric corona discharge during corona pretreatment. Thereby, a commercial device for corona pretreatment can be used.

This corona pretreatment serves to clean the surface of the print substrate from materials, which have been accumulated by set off on the sealing side or by migration on the surface. Besides, polar molecules are thereby created on the surface to which the primer can adhere better.

According to a further example embodiment, after the corona pretreatment, a primer or adhesion promoter is applied on the printing side of said composite (multilayer laminate) or of said film in order to provide a better color adhesion. According to one example embodiment, said applying is performed dryly from 0.1 to 1 g/m2.

According to one example embodiment, a solvent-based primer is used, for example a primer based on an organic solvent. Primers, which are based on an organic solvent, provide increased mechanical and thermal stability of the printed end product in comparison with conventional primers for digital printing, which are based on aqueous solvents.

According to one example embodiment, the primer based on an organic solvent is a two-component primer.

According to one example embodiment, the two components can for example be a two-component primer based on polyurethane and isocyanate. Thereby, good mechanical and thermal stability is provided.

According to one example embodiment the applying of the solvent-based primer is performed with a separate device and not with the device for digital printing. Thereby, the use of a solvent-based primer is possible, which is not possible with conventional digital printing devices due to their lacking explosion protection.

Thereby, it is possible that the roll primed in a separate device can lie for different times until printing is performed. Due to the different lying times of said primed roll, which may be one day up to several months, exceptionally up to a maximum of 2 years, the set off or the migration is differently large. This can result in a low stability of the print image, if the color is directly applied on the primer as provided in conventional printing methods.

According to one example embodiment digital printing is performed on the preprimed composite (multilayer laminate) or the film, whereby however—preferably inline—the primed side of the composite (multilayer laminate) or of the film is processed by a corona pretreatment.

This pretreatment serves to clean the surface of the (thin) primer layer (005) from materials, which have been accumulated on the surface due to set off or migration. According to one example embodiment the corona pretreatment is performed in its corona strengths corresponding to the comparatively thin primer layer having a thickness of preferably 0.1 to 1 g/m2.

According to one example embodiment the corona strengths is in the range of 3 to 20 W min/m2.

The digital printing is performed on said corona-pretreated side (006) of the primer.

According to one example embodiment a protective paint against physical, thermal or chemical influences is then applied for the actual usage of the composite (multilayer laminate) or the film. Therefore, a protective painting is performed on the digitally printed composite (multilayer laminate) or the film. The applying amount of said protective paint is according to one example embodiment 0.3 to 2 g/m2 dry. The applying amount of the protective paint can vary depending on the usage of the film/the composite and the color applying amount. Preferably, a higher amount of protective paint is applied to when the color applying amount is higher.

According to one example embodiment the digitally printed side of the composite (multilayer laminate) or of the film is prior to the applying of the protective paint processed with a corona pretreatment—preferably inline—for providing a better protective paint adhesion on the digitally printed side.

This pretreatment serves to clean the surface of the digitally printed side of the composite (multilayer laminate) or of the film from materials, which have been accumulated on the surface due to set off or migration.

This is advantageous since the set off or the migration can be differently large due to differently large lying times of the digitally printed roll ranging from one day up to several months. A good adhesion of the protective paint is achieved by the corona pretreatment despite the possibly large set off.

According to one example embodiment a protective paint based on an organic solvent is used.

The solvent based protective paint (009) can be applied by a separate device or inline by the device for digital printing.

According to one example embodiment, a radiation curing protective paint can be used. According to another example embodiment it can be cured by an electron beamer. According to a further example embodiment it can be cured by UV-curing.

According to one example embodiment, a digital printing device of the type HP Indigo is used for the digital printing. Since this device is not explosion protected and is therefore not suitable for using a primer based on an organic solvent, priming is preferably performed by a separate device.

According to one example embodiment printing of the composite film is performed by digital outside printing so that further processing steps being necessary for the inside printing, for example laminating, are omitted.

According to another example embodiment a primer based on an organic solvent is used, which improves the stability of the print.

According to one example embodiment a corona pretreatment is performed, and the printing and the applying of the protective paint are performed before the priming. Thereby, a particularly stable print image is achieved, which fulfils the high mechanic, thermal and chemical stability requirements for films to be sealed.

Performing such a corona pretreatment in particular before the steps of the printing and the applying of the protective paint is not obvious since a person of ordinary skill in the art would have assumed that the corona pretreatment has negative influences on the primer layer due to its aggressiveness and therefore negatively influences the stability of the print image.

However, the inventors of the present invention have realized that this is not true and that in particular a corona pretreatment of the primed layer before the printing with digital printing methods, preferably still another corona pretreatment before the applying of the protective paint, increases the stability of the print image and in particular provides a sufficient mechanical, thermal and chemical stability for sealable films. Thereby, it is particularly advantageous if a corona pretreatment is performed before the priming, the digital printing, as well as the applying of the protective paint.

It is further particularly advantageous if the primer is a primer based on an organic solvent, preferably a two-component primer.

According to one example embodiment the printing is performed by a device of the type HP Indigo.

FIG. 1 schematically illustrates a method according to a preferred embodiment.

The multilayer composite (001) provides a printing side (003) and a sealing side (002).

First, a corona pretreatment (004) is performed on the printing side, then the primer (005) is applied. Thereafter, a further corona pretreatment (006) is performed followed by the digital printing (007). After a repeated corona pretreatment (008), the protective paint is applied (009).

A printed composite can be produced with this printing method, which fulfills the special chemical, thermal and mechanical stability requirements for sealable composites.

According to one example embodiment of the present invention a film or a composite film is provided, which has been produced by a method according to an example embodiment and has been corona-pretreated before the priming, before the digital printing and before the applying of the protective paint, According to a further example embodiment of the present invention a device is provided which includes respective modules for carrying out the method steps according to an example embodiment of the present invention.

It is clear to a person of ordinary skill in the art that features of the above described example embodiments can be arbitrarily combined with each other, such combinations are covered by the present disclosure.

Moreover, the expression digital printing of a composite film or a film means digitally printing or imprinting on said composite film or said film.

What is claimed is:

1. A method for digital printing of a film having a sealing side and a printing side, the method comprising:

performing a first corona treatment of the printing side of the film;

priming the printing side of the film with a primer subsequent to the first corona treatment;

performing a second corona treatment of the primer on the printing side subsequent to the priming of the film;

printing on the corona-treated and primed film using a digital printing method; and applying of a protective paint on the printed, corona-treated and primed film.

2. The method of claim 1, further comprising:

performing a third corona pretreatment of the printed, corona-treated and primed film before the applying of the protective paint.

3. The method of claim 1, wherein the primer is a primer based on an organic solvent.

4. The method of claim 1, wherein the primer is a two-component primer.

5. The method of claim 1, wherein the protective paint is a protective paint based on an organic solvent.

6. The method of claim 1, wherein the protective paint is a two-component protective paint.

7. The method of claim 1, wherein the primer is applied with a thickness of 0.1 to 1 g/m2.

8. The method of claim 1, wherein the protective paint is applied with a thickness of 0.3 to 2 g/m2.

9. The method of claim 1, wherein a radiation curing paint is used as protective paint.

10. The method of claim 9, wherein the protective paint is cured by electron beam curing, or the protective paint is cured by UV curing.

11. A film, produced by a method according to claim 1.

12. The method of claim 1, wherein the film is a composite film.

13. A composite film, produced by a method according to claim 1.

* * * * *